US009393454B2

(12) United States Patent
Lagree et al.

(10) Patent No.: US 9,393,454 B2
(45) Date of Patent: Jul. 19, 2016

(54) EXERCISE MACHINE TENSION SYSTEM

(71) Applicant: The Superformers, Inc., West Hollywood, CA (US)

(72) Inventors: Sebastien Anthony Louis Lagree, West Hollywood, CA (US); John C. Hamilton, Santa Clara, CA (US); Andy H. Gibbs, Palm Springs, CA (US)

(73) Assignee: SPX Fitness, Inc., Burbank, CA (US)

( * ) Notice: Subject to any disclaimer, the term of this patent is extended or adjusted under 35 U.S.C. 154(b) by 79 days.

(21) Appl. No.: 14/065,939

(22) Filed: Oct. 29, 2013

(65) Prior Publication Data

US 2014/0121078 A1 May 1, 2014

Related U.S. Application Data

(60) Provisional application No. 61/719,763, filed on Oct. 29, 2012.

(51) Int. Cl.

| | |
|---|---|
| ***A63B 21/068*** | (2006.01) |
| ***A63B 21/02*** | (2006.01) |
| ***A63B 21/00*** | (2006.01) |
| ***A63B 22/00*** | (2006.01) |

(52) U.S. Cl.

CPC ..... *A63B 21/025* (2013.01); *A63B 21/00065* (2013.01); *A63B 21/153* (2013.01); *A63B 22/0089* (2013.01)

(58) Field of Classification Search

CPC ..... A63B 22/0087

See application file for complete search history.

(56) References Cited

U.S. PATENT DOCUMENTS

| | | | | |
|---|---|---|---|---|
| 6,045,491 | A * | 4/2000 | McNergney | A63B 21/153 482/121 |
| 7,137,936 | B1 * | 11/2006 | Shaw | A63B 21/025 182/101 |
| 7,803,095 | B1 | 9/2010 | Lagree | |
| 8,641,585 | B2 | 2/2014 | Lagree | |
| 2004/0043873 | A1 * | 3/2004 | Wilkinson et al. | 482/54 |
| 2013/0167781 | A1 * | 7/2013 | Marshall | A01K 29/00 119/794 |

* cited by examiner

*Primary Examiner* — Loan H Thanh
*Assistant Examiner* — Rae Fischer
(74) *Attorney, Agent, or Firm* — Neustel Law Offices; Michael S. Neustel

(57) ABSTRACT

An exercise machine tension system for improving functionality and linear resistance of a Pilates machine. The exercise machine tension system generally includes an exercise machine including a carriage slidably positioned thereon. A plurality of tension units are connected between the exercise machine and the carriage for creating linear resistance as the carriage is drawn in a first direction and reverting the carriage back to its original position absent application of force. Each tension unit includes a housing, a reel rotatably positioned within the housing, a torsion spring secured to the reel, and a flexible member wound around the reel and extending out of the housing. The housing is secured to the exercise machine and the distal end of the flexible member is secured to the carriage.

19 Claims, 14 Drawing Sheets

EXERCISE MACHINE TENSION SYSTEM

CROSS REFERENCE TO RELATED APPLICATIONS

I hereby claim benefit under Title 35, United States Code, Section 119(e) of U.S. provisional patent application Ser. No. 61/719,763 filed Oct. 29, 2012. The 61/719,763 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an exercise machine and more specifically it relates to an exercise machine tension system for improving functionality and linear resistance of a Pilates machine.

2. Description of the Related Art

Any discussion of the related art throughout the specification should in no way be considered as an admission that such related art is widely known or forms part of common general knowledge in the field.

Exercise machines are becoming increasingly popular as more and more people seek to maintain a fit and healthy lifestyle. One such exercise machine which is exceedingly popular in present times is the Pilates machine. A conventional Pilates machine includes a movable carriage which may be utilized to perform a wide range of exercises through motion of the carriage along a track.

In the past, springs have connected the carriage to the exercise machine. When the carriage is moved in a first direction along the track, the springs provide linear resistance to increase the effectiveness of the exercise. Absent force, the carriage returns to its rested position.

The springs utilized within such exercise machines will eventually fail due to fatigue from the repeated cycles. Because of the linear nature of these springs and their long length, they will often lose effectiveness fairly quickly through repeated use, particularly when the exercise machine is in a public gym. When such a spring experiences failure while under tension, the two or more pieces of the fractured spring can behave radically and unpredictably to become projectiles or whips that can cause serious injury to the user.

Because of the inherent problems with the related art, there is a need for a new and improved exercise machine tension system for improving functionality and linear resistance of a Pilates machine.

BRIEF SUMMARY OF THE INVENTION

The invention generally relates to an exercise machine which includes an exercise machine including a carriage slidably positioned thereon. A plurality of tension units are connected between the exercise machine and the carriage for creating linear resistance as the carriage is drawn in a first direction and reverting the carriage back to its original position absent application of force. Each tension unit includes a housing, a reel rotatably positioned within the housing, a torsion spring secured to the reel, and a flexible member wound around the reel and extending out of the housing. The housing is secured to the exercise machine and the distal end of the flexible member is secured to the carriage.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
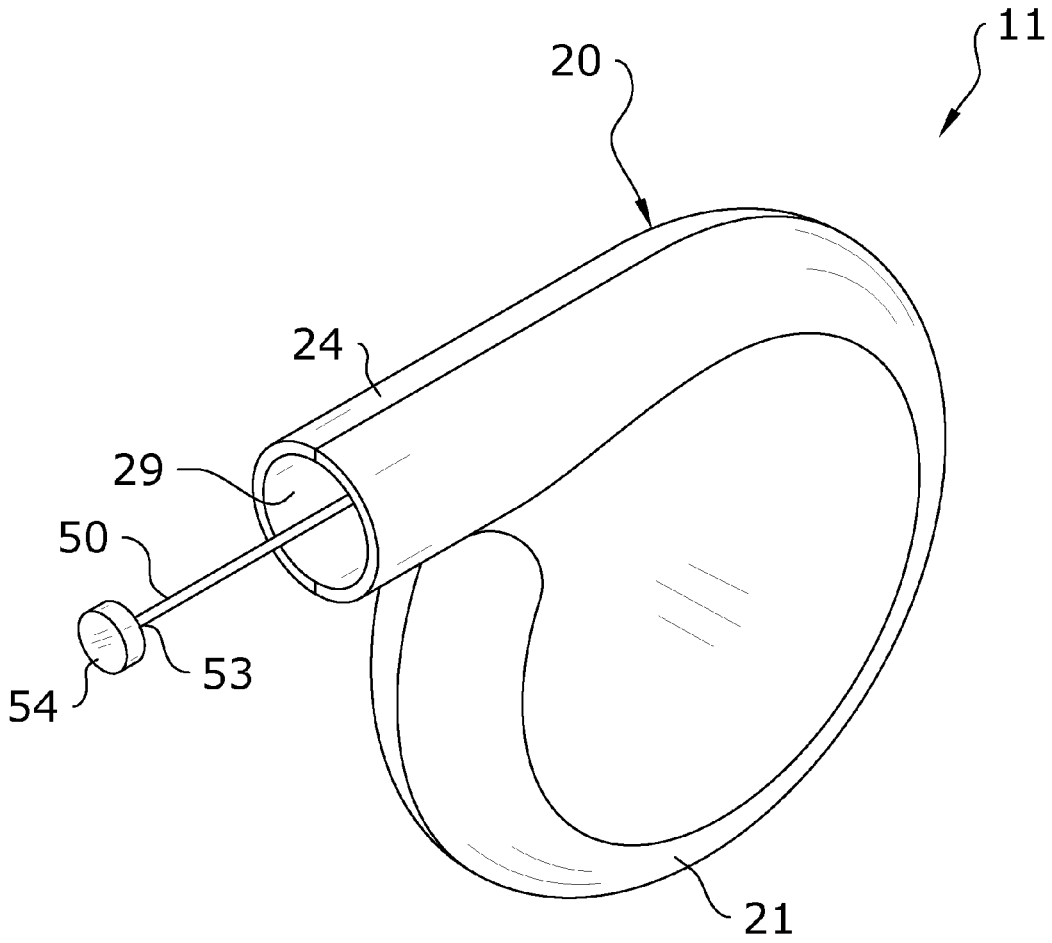
FIG. 1 is a rear upper perspective view of a tension unit of the present invention.

A. Overview.

Turning now descriptively to the drawings, in which similar reference characters denote similar elements throughout the several views, FIGS. 1-16 illustrate a exercise machine tension system 10, which comprises an exercise machine 80 including a carriage 90 slidably positioned upon a frame 81 thereof. A plurality of tension units 11 are connected between the exercise machine 80 and the carriage 90 for creating linear resistance as the carriage 90 is drawn in a first direction and reverting the carriage 90 back to its original position absent application of force. Each tension unit 11 includes a housing 20, a reel 30 rotatably positioned within said housing, a torsion spring 70 secured to the reel 30, and a flexible member 50 wound around the reel 30 and extending out of the housing 20. The distal end 53 of the flexible member 50 is secured to the carriage 90.

B. Exercise Machine.

FIGS. 13-16 illustrate an exemplary exercise machine 80 for use with the present invention. In particular, the present invention is preferably utilized within a Pilates exercise machine 80 as illustrated in FIGS. 13-16. While the figures and description illustrate and describe the exercise machine 80 as being comprised of a Pilates machine, it is appreciated that the present invention may be utilized in combination with other exercise machines such as weight machines and the like.

Figure 13:
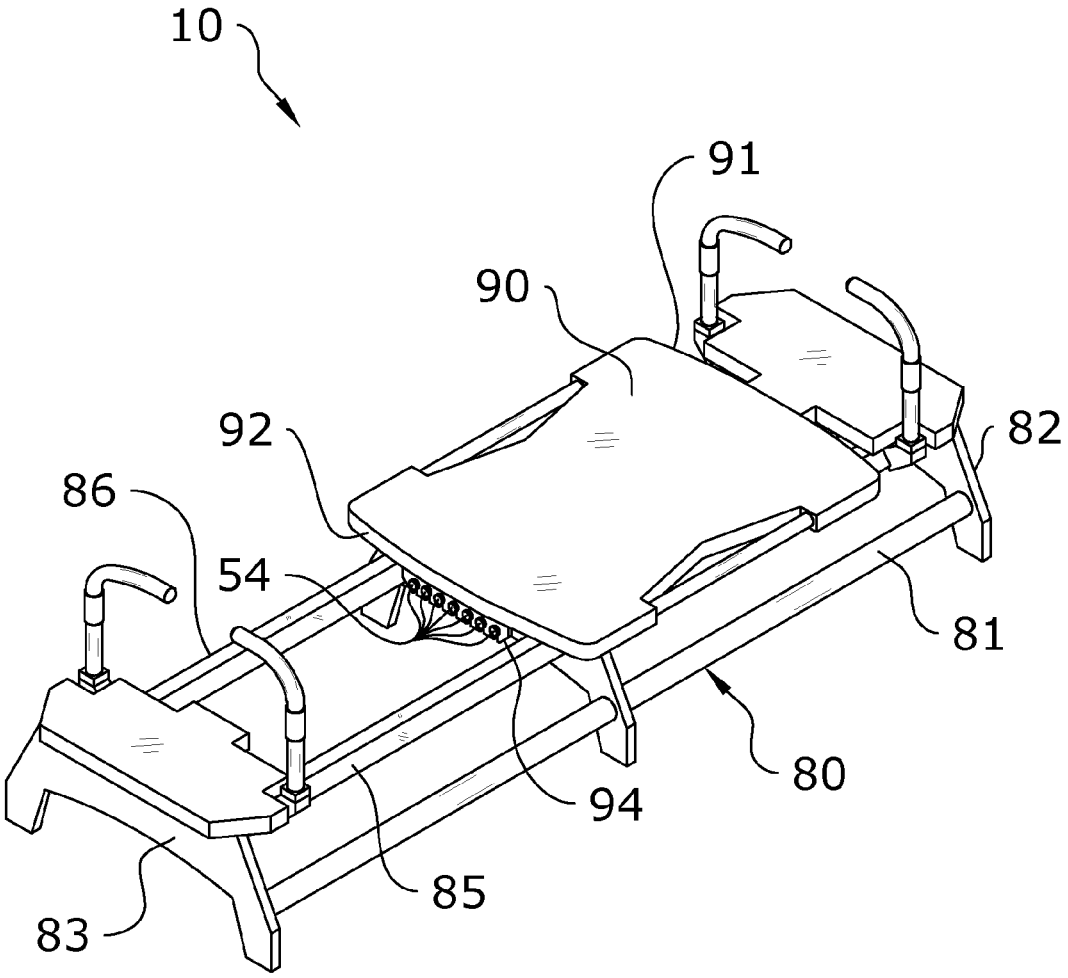
FIG. 13 is an upper perspective view of an exercise machine with the carriage in a rested position.

As shown in FIG. 13, the exemplary exercise machine 80 comprises a frame 81 which includes a first end 82 and a second end 83. A first rail 85 and a second rail 86 each extend between the first and second ends 82, 83 of the frame 81 in a parallel manner with respect to each other. A carriage 90 is movably secured to the rails 85, 86 so that the carriage 90 may be slid, rolled, or otherwise moved between the first end 82 and the second end 83 of the frame 81.

Figure 15:
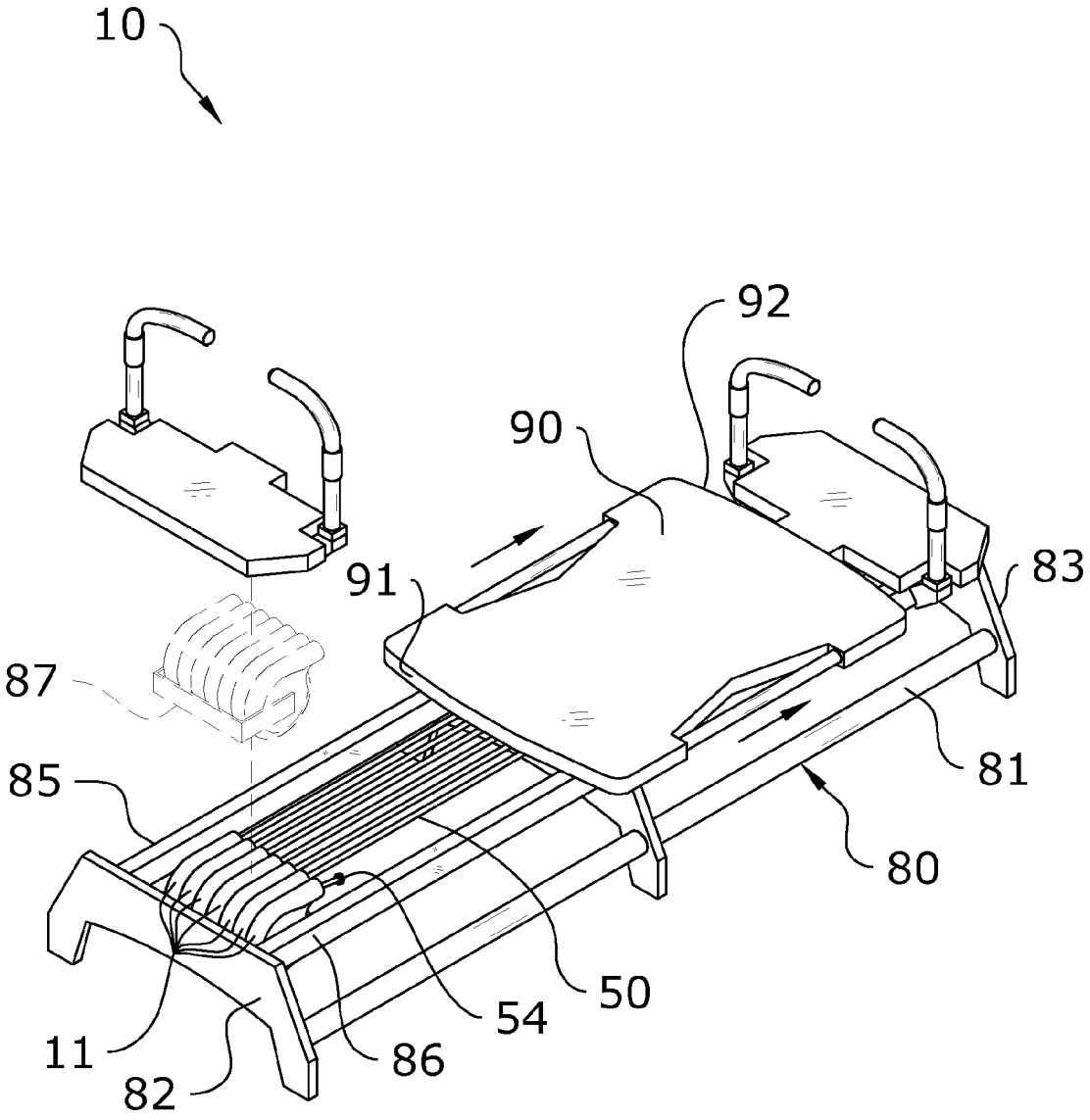
FIG. 15 is an upper perspective view illustrating positioning of the tension units within the exercise machine.
Figure 16:
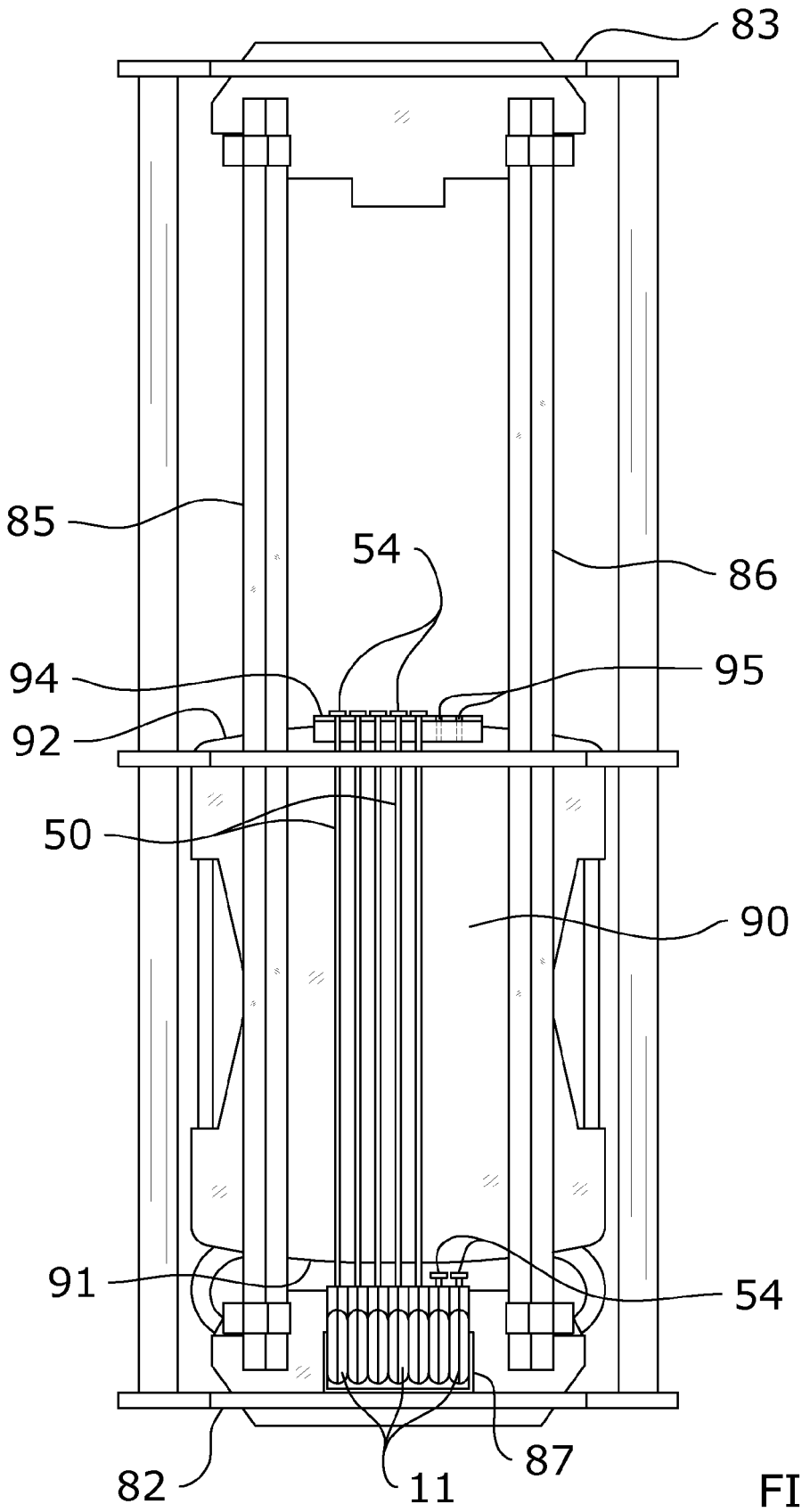
FIG. 16 is a top cutaway view illustrating positioning of the tension units within the exercise machine and the connection between the flexible members and carriage of the exercise machine.

The first end 82 of the frame 81 includes one or more tension units 11 secured between the first and second rails 85, 86 as best shown in FIGS. 15 and 16. It should be noted that the present invention is adapted for use with any number of tension units 11, and thus the scope of the present invention should not be construed as limited to the specific number and orientation shown in the figures.

Where a plurality of tension units 11 is utilized, the tension units 11 are preferably vertically-oriented and positioned side-by-side with respect to each other as shown in the figures. The tension units 11 may be secured to the first end 82 of the frame 81 between its first and second rails 85, 86 through a variety of structures, methods, and the like. In a preferred embodiment as shown in FIG. 15, a bracket 87 may be secured to the first end 82 of the frame 81, with the tension units 11 being secured within the bracket 87.

Figure 14:
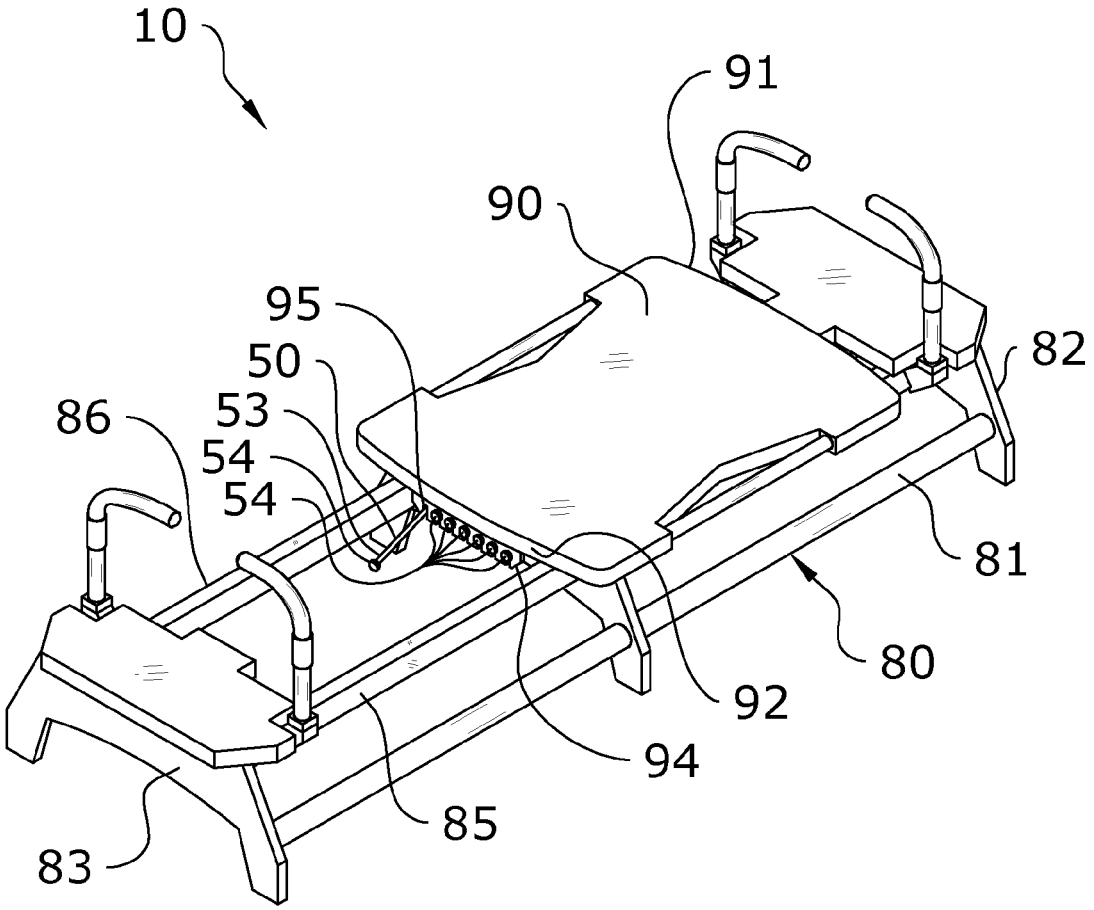
FIG. 14 is an upper perspective view of an exercise machine illustrating removal of a flexible member from the carriage thereof.

FIG. 14 illustrates the carriage 90 of the exercise machine 80 in a rested position, wherein the first end 91 of the carriage 90 is positioned at the first end 82 of the frame 81. FIG. 15 illustrates the carriage 90 of the exercise machine 80 in a second position at the second end 83 of the frame 81, wherein the carriage 90 has been moved across the rails 85, 86 such that the second end 92 of the carriage 90 is positioned at the second end 83 of the frame 81. In use, an operator of the present invention will position himself on the carriage 90 and perform various exercises which involve movement of the carriage 90 between the first and second ends 82, 83 of the frame 81.

Each of the tension units 11 includes a flexible member 50 extending therefrom as shown throughout the figures and described below. Each flexible member 50 extends underneath the carriage 90, with the distal end 53 of each flexible member 50 being secured to the second end 92 of the carriage 90.

Preferably, the distal end 53 of each flexible member 50 will be removably secured to the second end 92 of the carriage 90 so that the number of tension units 11 producing linear resistance to motion of the carriage 90 may be varied. By selectively engaging/disengaging the flexible members 50 to/from the carriage 90, more or less linear resistance may be applied to movement of the carriage 90 across the frame 81.

In a preferred embodiment as best shown in FIG. 16, a retainer 94 is secured to the second end 92 of the carriage 90. The retainer 94 is adapted to removably receive the attachment members 54 of the flexible members 50. The attachment members 54 are discussed in more detail below. The retainer 94 is preferably comprised of a plate, elongated member, or other structure which includes a plurality of receiver slots 95 formed therein; the receiver slots 95 being adapted to removably retain the attachment members 54 of the flexible members 50. Thus, the flexible members 50 (and, by extension, the tension units 11) may be easily and quickly connected/disconnected to/from the carriage 90 to vary the linear resistance being applied to motion of the carriage 90.

C. Housing.

As best shown in FIGS. 1-5 and 8-10, each tension unit 11 generally includes a housing 20 in which the reel 30 is rotatably secured. The housing 20 includes an opening 29 through which the flexible member 50 extends prior to being secured to the carriage 90 of the exercise machine 80. The housing 20 is adapted to be secured to the exercise machine 80 as shown in FIGS. 15 and 16. It should be noted that, in some embodiments, the housing 20 may be omitted entirely, with the reel 30 being secured directly to the exercise machine 80.

Figure 2:
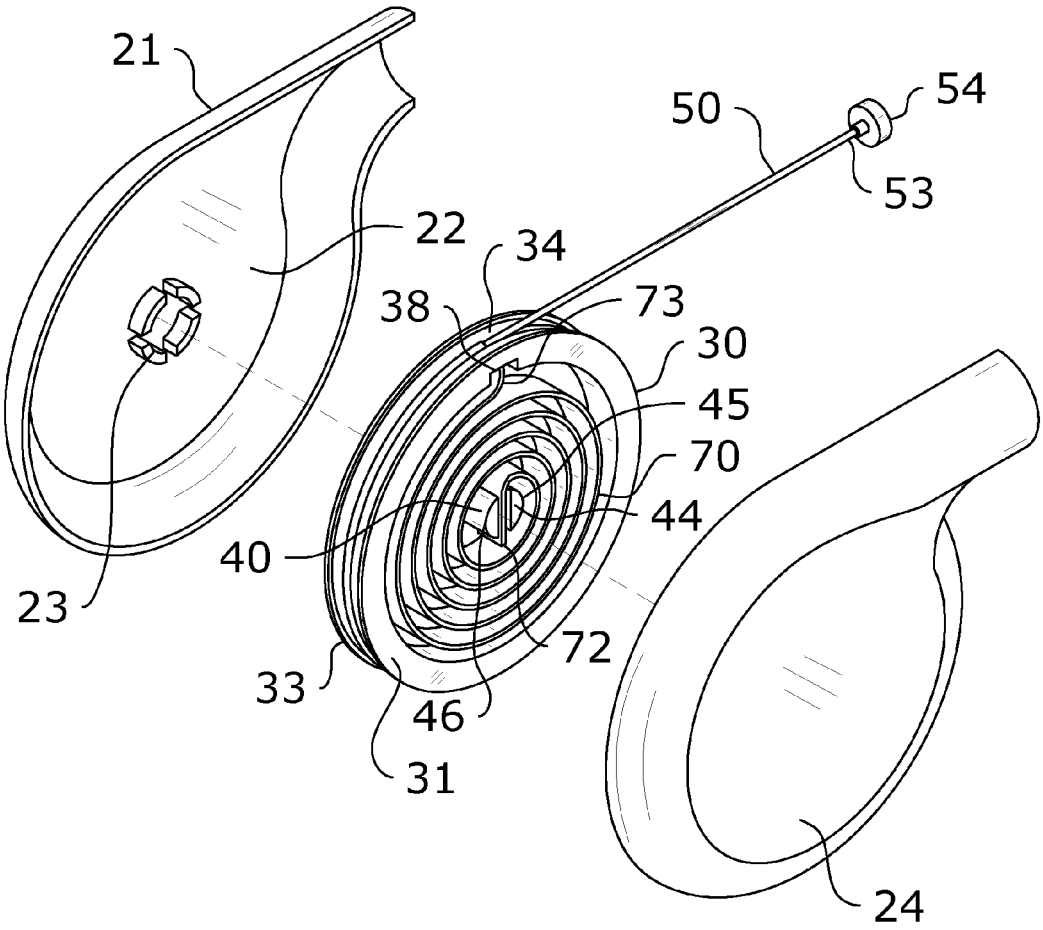
FIG. 2 is an exploded frontal upper perspective view of a tension unit of the present invention illustrating the torsion spring in a rested position.

As best shown in FIG. 2, the housing 20 may comprise a first outer shell 21 and a second outer shell 24. The outer shells 21, 24 are generally connected to each other so as to enclose the reel 30 therebetween. In some embodiments, the outer shells 21, 24 may be integrally formed of a unitary structure to form the housing 20. The shape, size, and configuration of the outer shells 21, 24 may vary depending on the embodiment of the present invention to suit different exercise machines 80. Thus, the exemplary shape, size, and configuration of the outer shells 21, 24 and housing 20 should not be construed as being limited by the exemplary figures.

The first outer shell 21 and second outer shell 24 are best shown in FIGS. 2-5. As shown therein, the first outer shell 21 includes an inner surface 22 which faces a corresponding inner surface 25 of the second outer shell 24. The inner surface 22 of the first outer shell 21 includes a first axle receiver 23 which is adapted to lockably receive the first end 41 of the axle member 40, which extends through the reel 30 and about which the reel 30 rotates. The reel 30 is preferably concentric with respect to the axle member 40.

Figure 10:
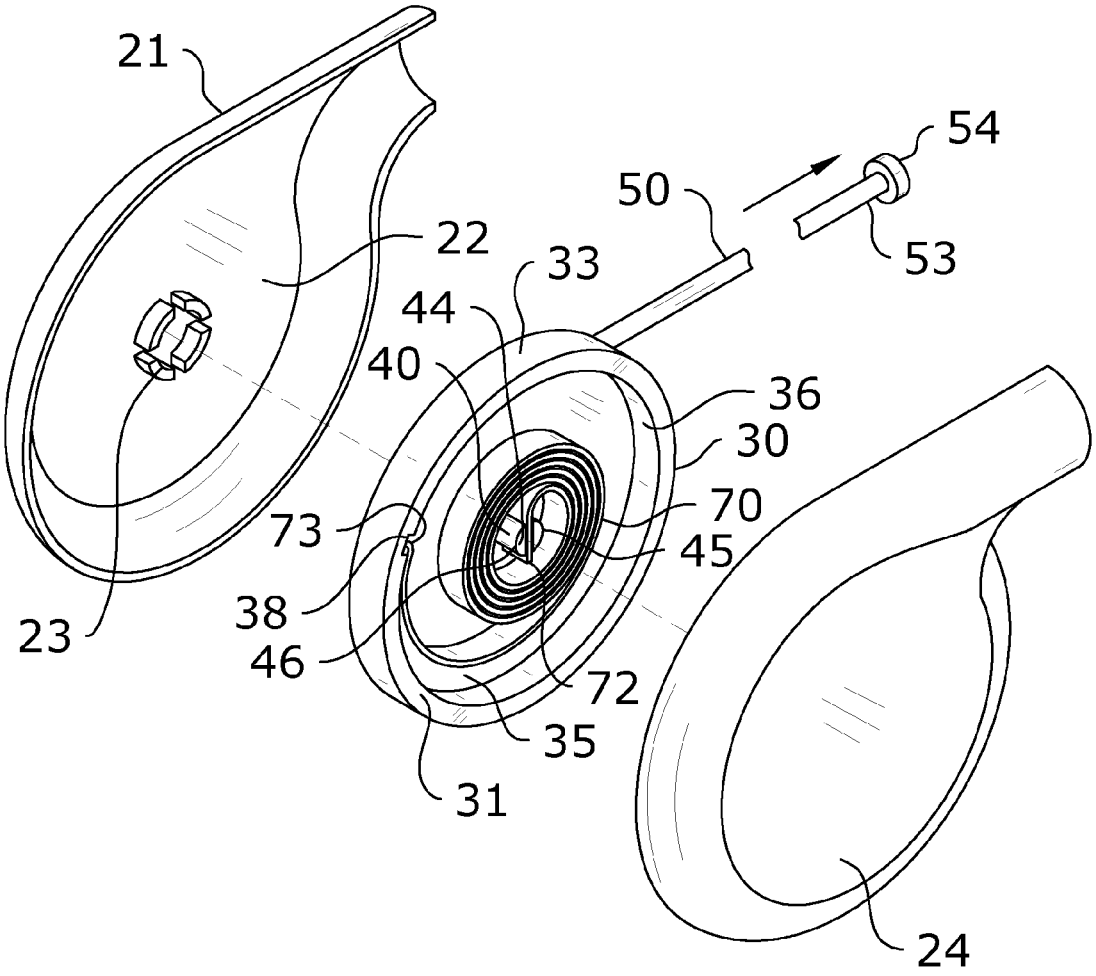
FIG. 10 is an exploded frontal upper perspective view of a second embodiment of a tension unit of the present invention illustrating the torsion spring in a biased position.
Figure 11:
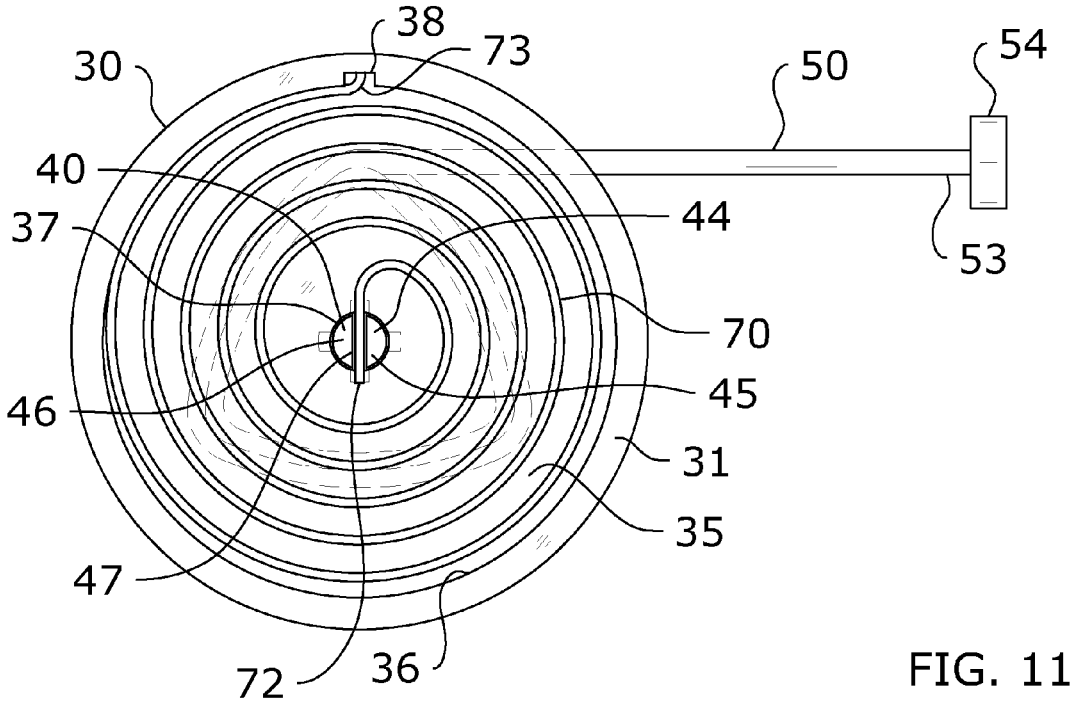
FIG. 11 is a side view of a first embodiment of the reel and torsion spring of the second embodiment of the tension unit of the present invention.
Figure 12:
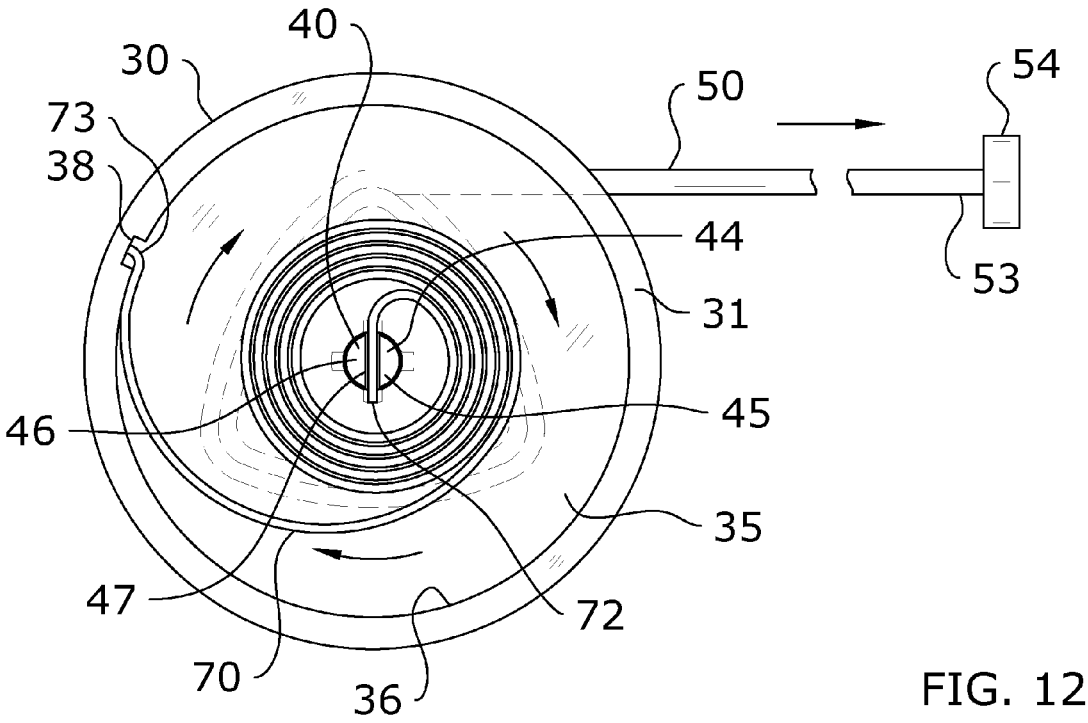
FIG. 12 is a side view of a second embodiment of the reel and torsion spring of the second embodiment of the tension unit of the present invention.

The first axle receiver 23 may be comprised of any structure which is adapted to lock in the first end 41 of the axle member 40. In a preferred embodiment as shown in FIG. 10, the first axle receiver 23 may include a plurality of slots or depressions which are adapted to matingly engage with and lock in the radial nubs 42 of the first end 41 of the axle member 40.

Figure 8:
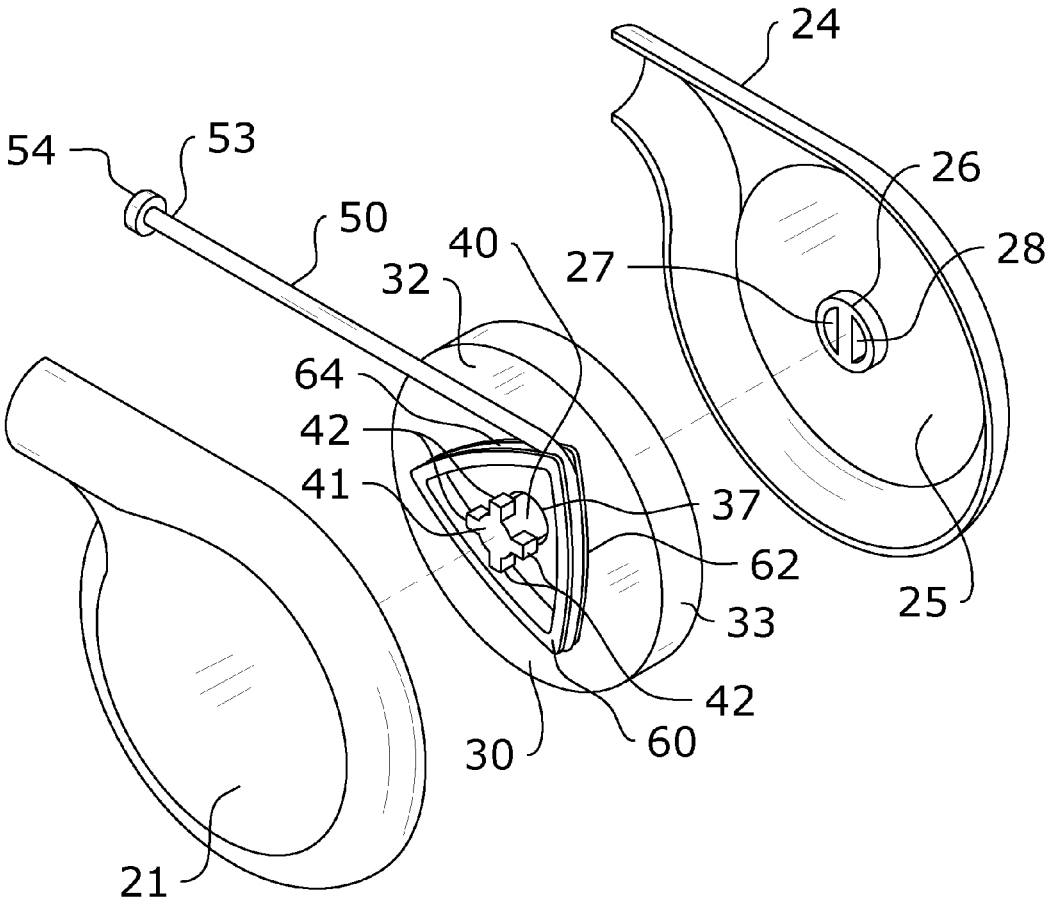
FIG. 8 is an exploded rear upper perspective view of a second embodiment of a tension unit of the present invention.

The inner surface 25 of the second outer shell 24 includes a second axle receiver 26 adapted to lockably receive the second end 44 of the axle member 40. The second axle receiver 26 is best shown in FIG. 8 and may include a pair of slots 27, 28, each adapted to matingly engage with and lock in the corresponding first and second members 45, 46 of the second end 44 of the axle member 40. Thus, both ends 41, 44 of the axle member 40 are lockably secured to the housing 20, with the first end 41 being secured within the first axle receiver 23 of the first outer shell 21 and the second end 44 being secured within the second axle receiver 26 of the second outer shell 24; allowing reel 30 to rotate about the axle member 40.

C. Reel.

As best shown in FIGS. 2-5 and 8-10, each tension unit 11 includes a reel 30 which is rotatably secured within the housing 20. However, in some embodiments, the reel 30 may be directly secured to the exercise machine 80 without usage of a housing 20. Use of a housing 20 is preferable, however, to shield the rotational movement of the reel 30 from objects or body parts.

Figure 9:
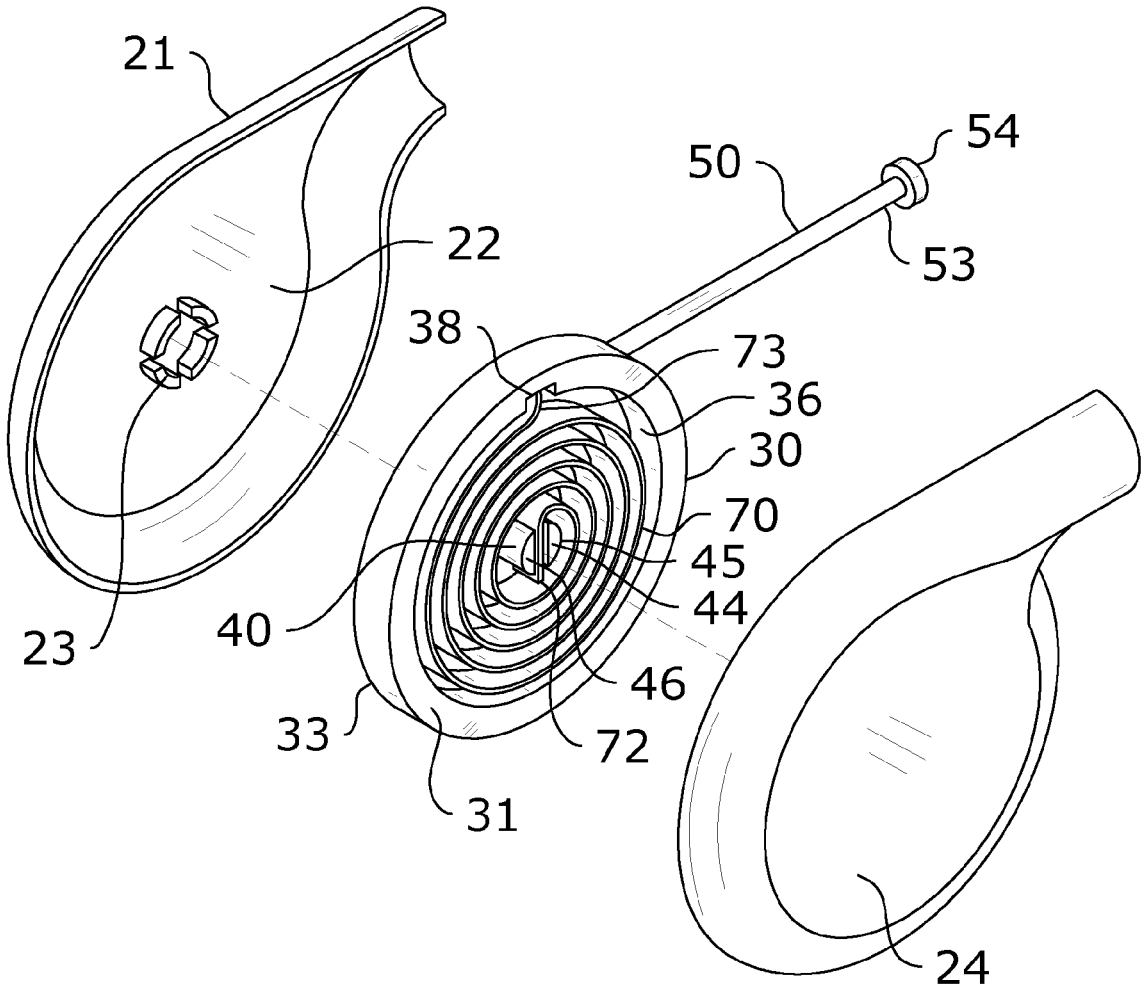
FIG. 9 is an exploded frontal upper perspective view of a second embodiment of a tension unit of the present invention illustrating the torsion spring in a rested position.

The reel 30 is generally comprised of a cylindrical member having a first side 31, a second side 32, and an outer circumference 33. A first embodiment of the reel 30 is shown in FIGS. 2-5 and a second embodiment of the reel 30 is shown in FIGS. 8-10. Either embodiment may be utilized with the tension units 11 of the present invention.

Figure 4:
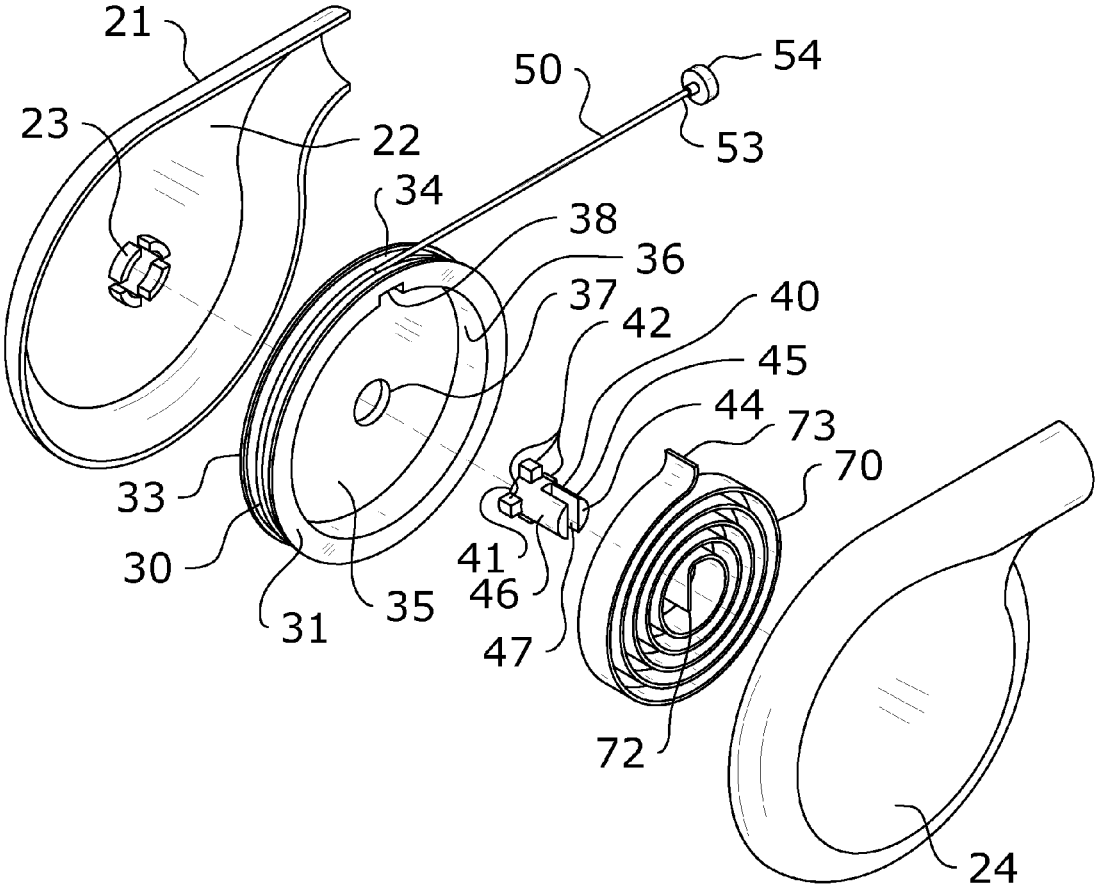
FIG. 4 is an exploded frontal upper perspective view of a tension unit of the present invention illustrating the positioning of the shells, reel, and torsion spring.

In both embodiments of the reel 30, the first side 31 of the reel 30 includes a torsion spring 70 secured thereto such that rotation of the reel 30 will bias the torsion spring 70. Preferably, as shown in FIGS. 4 and 9, the first side 31 of the reel 30 includes a recessed portion 35 or depression in which the torsion spring 70 is positioned and secured as described herein.

An inner circumference 36 of the recessed portion 35 may include a spring retainer 38 as shown in the figures. The spring retainer 38 is adapted to receive and secure the second end 73 of the torsion spring 70 as will be described below. The spring retainer 38 may be a slot, clip, or other structure adapted to retain the second end 73 of the torsion spring 70.

Figure 5:
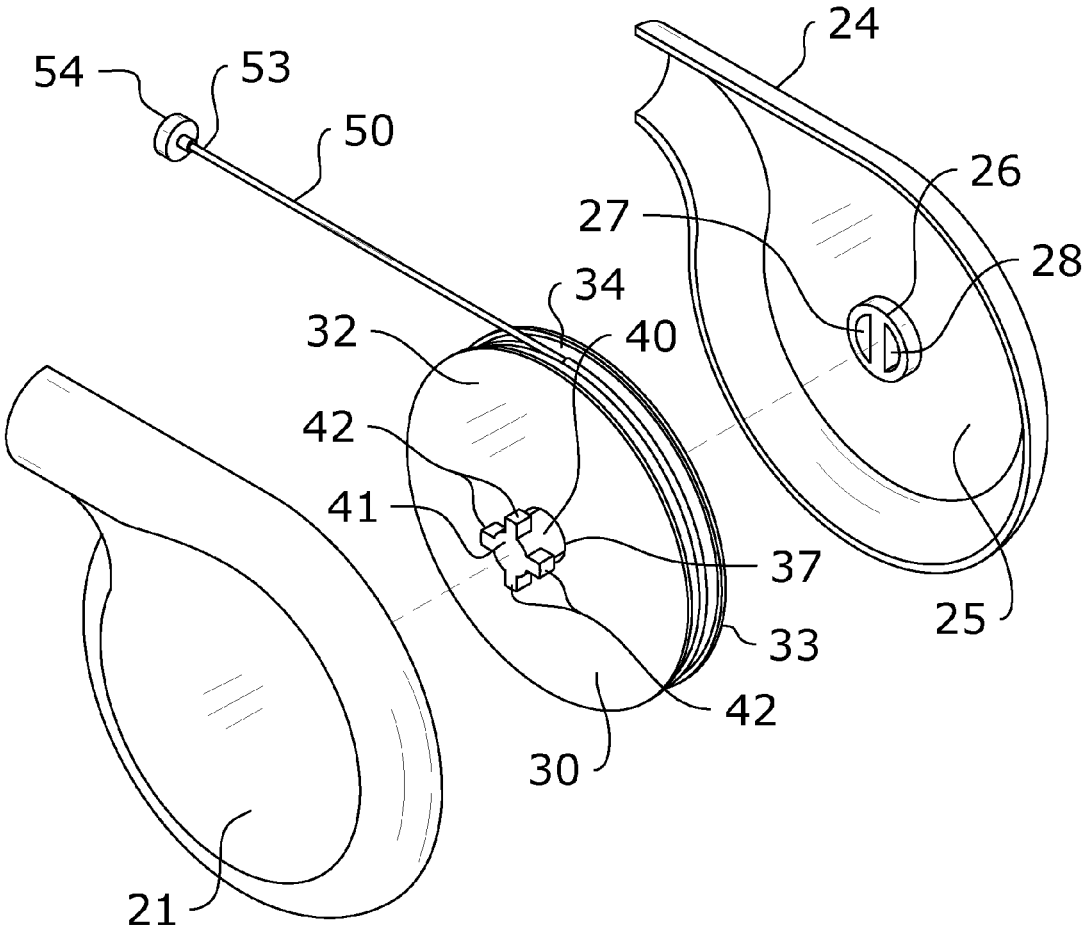
FIG. 5 is an exploded rear upper perspective view of a tension unit of the present invention.

A central opening 37 extends through a central point of the recessed portion 35, with the axle member 40 extending through the central opening 37 as shown in FIG. 5. The first end 41 of the axle member 40 will extend outwardly from the first side 31 of the reel 30 through the central opening 37 and the second end 44 of the axle member 40 will extend outwardly from the second side 32 of the reel 30 through the central opening 37.

Figure 3:
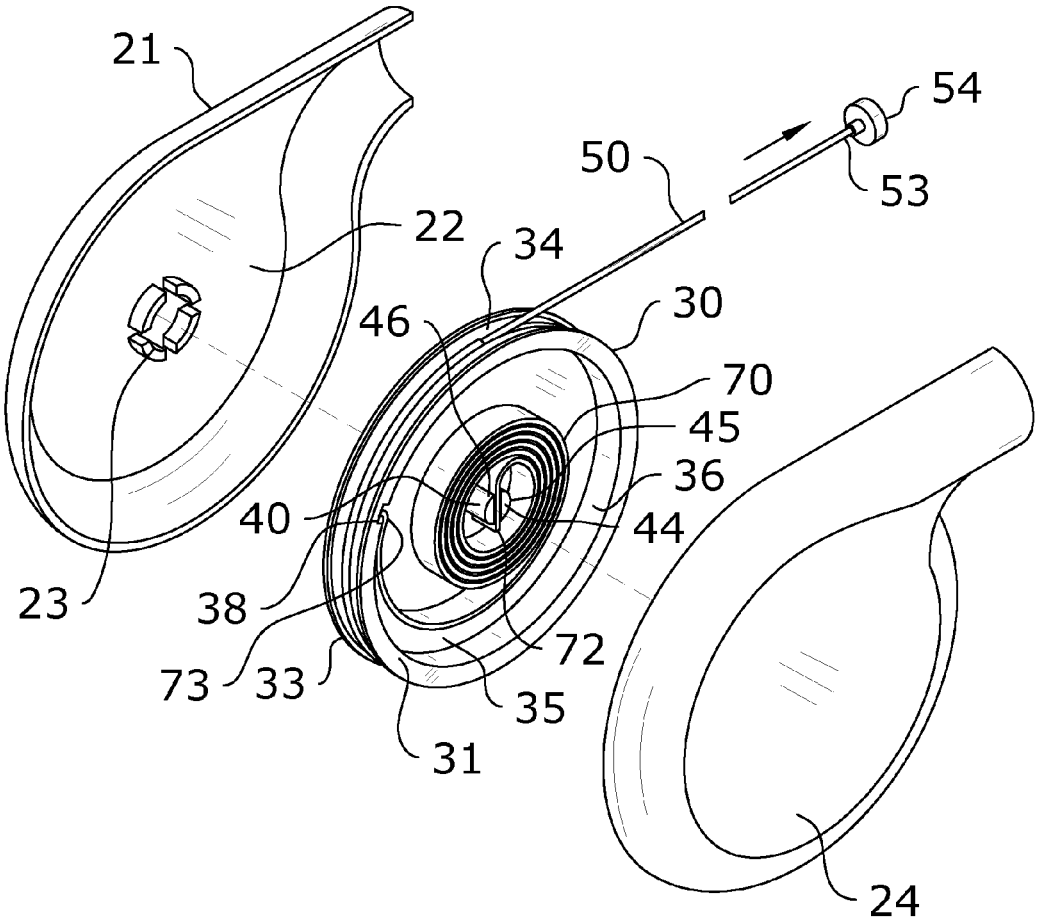
FIG. 3 is an exploded frontal upper perspective view of a tension unit of the present invention illustrating the torsion spring in a biased position.

The first embodiment of the reel 30 shown in FIGS. 2-5 includes a groove 34 formed within the outer circumference 33 of the reel 30. The flexible member 50 of the present invention is wound within the groove 34 so as to be unwound therefrom when the reel 30 rotates in a first direction and wound back thereon when the reel 30 rotates in a second direction as shown in FIGS. 2-3.

The second embodiment of the reel 30 shown in FIGS. 8-10 includes a cam 60 positioned on the second side 32 of the reel 30. The cam 60 is generally raised from the second side 32 of the reel 30 and comprised of a substantially triangular configuration with curved corners and bowed outer edges as best shown in FIG. 8. The outer circumference 62 of the cam 60 includes a groove 64. The flexible member 50 of the present invention is wound within the groove 64 so as to be unwound therefrom when the reel 30 rotates in a first direction and wound back thereon when the reel 30 rotates in a second direction.

The use of a cam 60 reduces the length of the crank arm as measured as the instant radius about the axle, consequently increasing the force required to unwind the flexible member 50 by pulling. By pulling the flexible member 50 from a cam 60 connected to a torsion spring 70, the resistance can be reduced to correspond to the exerciser's relative strength throughout the range of motion. This can substantially reduce the likelihood for injury throughout the exercise range of motion.

D. Axle Member.

As best shown in FIG. 4, the present invention includes an axle member 40 which extends through the central opening 37 of the reel 30 and is secured at its first end 41 to the inner surface 22 of the first outer shell 21 and at its second end 44 to the inner surface 25 of the second outer shell 24.

The respective ends 41, 44 of the axle member 40 are locked in place against the housing 20 so that the reel 30 may freely rotate about the axle member 40. A bearing or lubricant, such as grease, may also be utilized to improve rotation of the reel 30 about the axle member 40.

The first end 41 of the axle member 40 may include a plurality of radial nubs 42 as shown in FIG. 4. The radial nubs 42 are comprised of outward projections which are adapted to matingly engage within corresponding slots formed in the first axle receiver 23, which extends from the inner surface 22 of the first outer shell 21. The nubs 42 will act to prevent rotation of the first end 41 of the axle member 40 within the first axle receiver 23.

The second end 44 of the axle member 40 is similarly locked in place against the housing 20 so that the reel 30 may freely rotate about the axle member 40. The second end 44 of the axle member 40 also acts to receive and secure the second end 73 of the torsion spring 70 as shown in FIGS. 2, 3, 6, and 9-12.

Thus, the second end 44 of the axle member 40 is preferably comprised of a first member 45 and a second member 46 extending in a spaced-apart relationship with each other so as to define a slot 47 therebetween. The second end 73 of the torsion spring 70 is secured within the slot 47 prior to connection between the second end 44 of the axle member 40 and the second axle receiver 26.

The first member 45 of the second end 44 of the axle member 40 fits within the first slot 27 of the second axle receiver 26. The second member 46 of the second end 44 of the axle member 40 fits within the second slot 28 of the second axle receiver 26. This configuration locks the second end 44 of the axle member 40 against the inner surface 25 of the second outer shell 24 of the housing 20 such that the reel 30 may freely rotate thereabout. This configuration also acts to secure the second end 73 of the torsion spring 70 against the housing 20 so that rotation of the reel 30 will coil up and bias the torsion spring 70 as described in more detail below.

E. Torsion Spring.

As shown throughout the figures, the torsion spring 70 is included to exert linear resistance against the flexible member 50 as it is drawn out of the housing 20, and to cause the flexible member 50 to retract into the housing 20 absent force. Various types of torsion springs 70 may be utilized. In a preferred embodiment as shown in the figures, a coil spring 70 is utilized.

The first end 72 (outer end) of the torsion spring 70 is secured and anchored within the spring retainer 38 of the reel 30. The spring retainer 38 is preferably comprised of a slot or any other structure adapted to retain and anchor the first end 72 of the torsion spring 70 therein. This configuration is best shown in FIGS. 2, 3, 9, and 10.

The second end 73 (inner end) of the torsion spring 70 is secured and anchored between the second end 44 of the axle member 40 and the second axle receiver 26. This configuration secures the second end 73 of the torsion spring 70 against the housing 20. By anchoring the second end 73 of the torsion spring 70 against the housing 20 and the first end 72 of the torsion spring 70 against the reel 30, rotation of the reel 30 will cause the torsion spring 70 to coil up and bias as shown in FIGS. 2, 3, 11, and 12.

Figure 6:
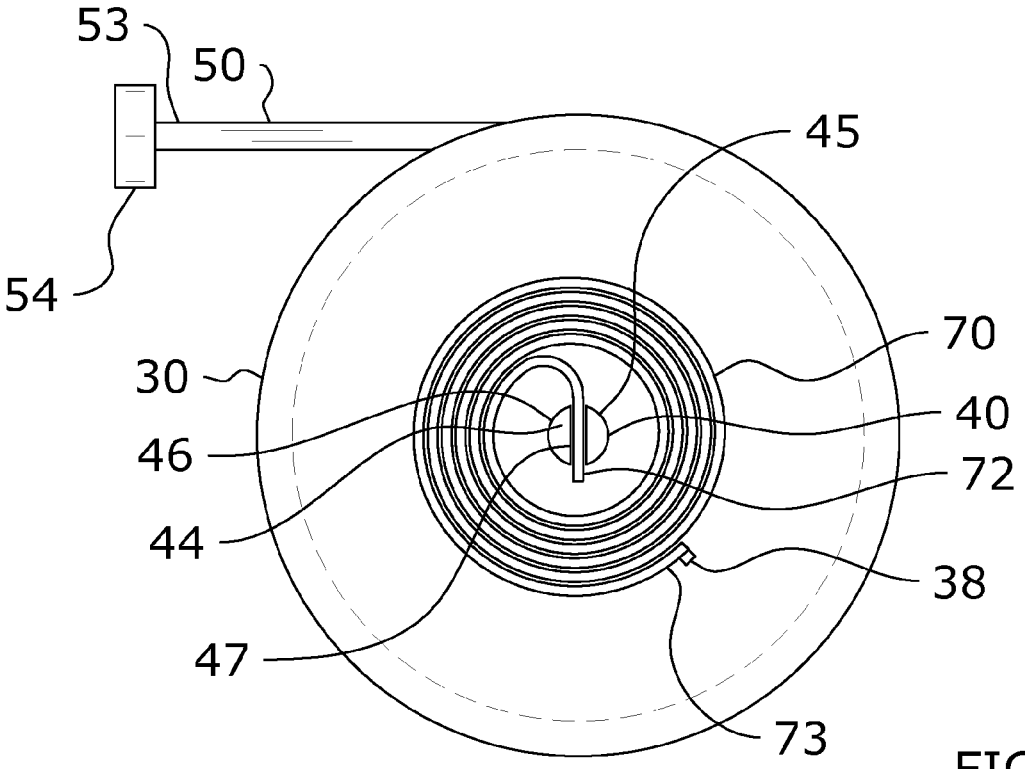
FIG. 6 is a side view of a first embodiment of the reel and torsion spring of the tension unit of the present invention.
Figure 7:
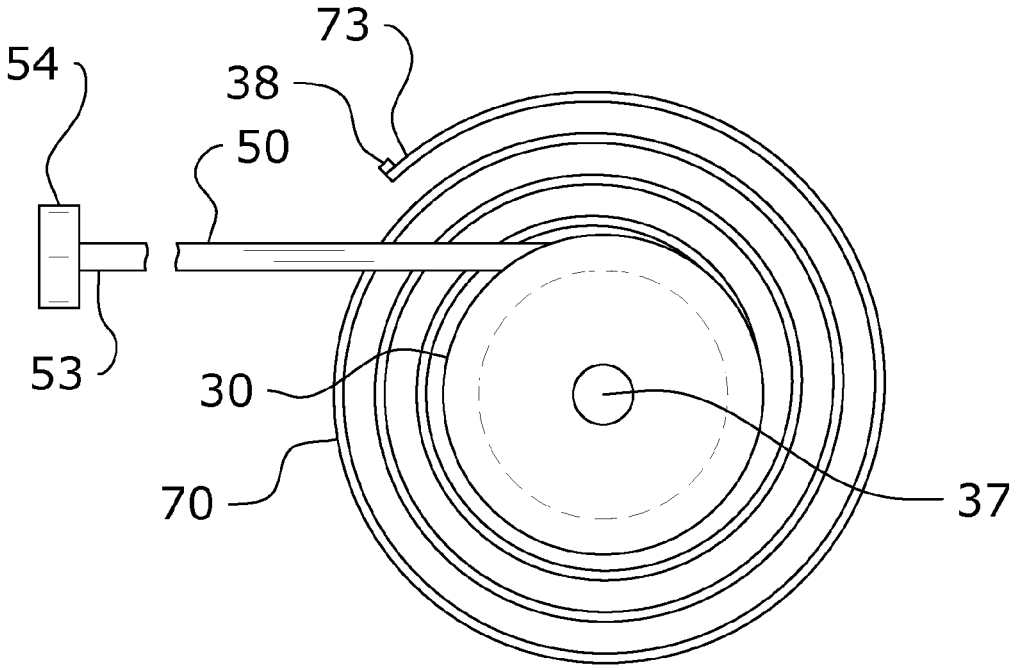
FIG. 7 is a side view of a second embodiment of the reel and torsion spring of the tension unit of the present invention.

FIGS. 6-7 illustrate alternate embodiments of the torsion spring 70 and reel 30 of the present invention. In FIG. 6, the torsion spring 70 is shown as having a diameter which is smaller than that of the reel 30. In FIG. 7, the torsion spring 70 is shown as having a diameter which is larger than that of the reel 30. Either configuration may be utilized so long as the torsion spring 70 is secured between the reel 30 and the housing 20, or the reel 30 and the exercise machine 80 in embodiments not utilizing a housing 20.

F. Flexible Member.

As shown throughout the figures, an elongated, flexible member 50 is included which is secured at a first end to the reel 30 and at its distal end 53 to the carriage 90 of the exercise machine 80. The flexible member 50 may be comprised of a rope, cable, chain, or other flexible material of high tensile strength.

The distal end 53 of the flexible member 50 may include an attachment member 54 as shown in the figures such as a tab, clip, or other structure which allows a quick connect and disconnect to/from the carriage 90. Preferably, the attachment members 54 are each comprised of a knob or other member which is adapted to be removably secured within a corresponding receiver slot 95 within the retainer 94 of the carriage 90. By selectively disengaging one or more of the tension units 11 from the carriage 14 through use of the attachment member 54, variable resistance may be achieved for different exercises.

G. Operation of Preferred Embodiment.

In use, one or more of the flexible members 50 are first secured to the retainer 94, which is positioned on the underside of the carriage 90 adjacent to its second end 92. The number of flexible members 50 secured thereto will depend on the level of resistance desired for the particular exercises being performed. The flexible member 50 may be grasped by its distal end 53 and the attachment member 54 positioned and removably secured within a corresponding receiver slot 95.

For example, a user desiring an easier workout may secure only one of the tension units 11 to the carriage 90 by securing the attachment member 54 of the flexible member 50 to the retainer 94 of the carriage 90. This will provide only limited linear resistance to motion of the carriage 90. A user desiring a more intense workout may increase the linear resistance to motion of the carriage 90 by selectively securing more tension units 11 to the carriage 90 through securing more flexible members 50 to the retainer 94. Thus, the linear resistance may be varied so as to allow for more intense or less intense workouts depending on the needs of the user.

An individual may then position himself on the carriage 90 to perform various exercises, most of which will involve moving the carriage 90 along the rails 85, 86 of the frame 81 of the exercise machine 80. As the carriage 90 is drawn in a first direction along the exercise machine 80 as shown in FIG. 15, the flexible members 50 will be drawn out of the tension units 11 and the torsion springs 70 of each tension unit 11 will coil and provide linear resistance to the drawing motion, thus improving the exercise of the user. When the force against the carriage 90 is released, the torsion springs 70 will cause the flexible members 50 to be drawn back to the tension units 11, which will cause the carriage 90 to return to its rested position as shown in FIG. 16.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A tension system for an exercise machine, comprising:

an exercise machine having a frame and a movable carriage, wherein said frame includes a first end and a second end, and wherein said movable carriage is movably positioned upon said frame and adapted for reciprocating movement between said first end and said second end of said frame during execution of an exercise; and a plurality of tension units attached to said exercise machine and operatively engaged with said movable carriage, wherein said plurality of tension units are positioned side-by-side between a first rail and a second rail of said exercise machine, wherein said plurality of tension units are positioned below a lower surface of said moveable carriage, wherein said plurality of tension units jointly provide a linear resistance to movement of said movable carriage in a first direction, wherein a level of said linear resistance is determined by the number of said plurality of tension units operatively engaged with said movable carriage, wherein said linear resistance is increased by operatively engaging additional tension units to said movable carriage, and wherein each of said tension units is comprised of:

a reel;

a flexible member wound around said reel, wherein a first end of said flexible member is connected to said reel and a second end of said flexible member is removably attached to said movable carriage; and a torsion spring secured to said reel such that said torsion spring exerts resistance on rotation of said reel as said flexible member is unwound from said reel.

2. The tension system for an exercise machine of claim 1, wherein said plurality of tension units are each vertically oriented.

3. The tension system for an exercise machine of claim 1, wherein said flexible members of said plurality of tension units extend parallel with respect to each other.

4. The tension system for an exercise machine of claim 1, wherein each of said plurality of tension units is further comprised of a housing, wherein said reel is rotatably positioned within said housing.

5. The tension system for an exercise machine of claim 4, wherein said housing includes an opening through which said second end of said flexible member extends.

6. The tension system for an exercise machine of claim 4, wherein a first end of said torsion spring is secured to said reel and a second end of said torsion spring is secured to said housing.

7. The tension system for an exercise machine of claim 1, wherein said movable carriage includes a retainer and wherein each of said plurality of tension units is further comprised of an attachment member connected to said second end of said flexible member, wherein said attachment member is adapted to be removably connected to said retainer of said movable carriage.

8. The tension system for an exercise machine of claim 1, wherein said torsion spring is comprised of a coil spring.

9. A tension system for an exercise machine, comprising:

an exercise machine having a frame and a movable carriage;

wherein said frame includes a first end and a second end;

wherein said movable carriage is movably positioned upon said frame adapted for reciprocating movement between said first end and said second end of said frame during execution of an exercise; and a plurality of tension units attached to said exercise machine;

wherein each of said plurality of tension units includes a reel and a flexible member having an elongated structure that is operatively engaged with said movable carriage, wherein said flexible member is wound around said reel;

wherein said plurality of tension units are positioned side-by-side between a first rail and a second rail of said exercise machine;

wherein said plurality of tension units are positioned below a lower surface of said movable carriage;

wherein said plurality of tension units jointly provide a linear resistance to movement of said movable carriage in a first direction;

wherein a level of said linear resistance is determined by the number of said plurality of tension units operatively engaged with said movable carriage;

wherein said linear resistance is increased by operatively engaging additional tension units to said movable carriage.

10. The tension system for an exercise machine of claim 9, wherein each of said tension units is comprised of:

wherein a first end of said flexible member is connected to said reel and a second end of said flexible member is removably attached to said movable carriage; and a torsion spring secured to said reel such that said torsion spring exerts resistance on rotation of said reel as said flexible member is unwound from said reel.

11. The tension system for an exercise machine of claim 10, wherein said torsion spring is comprised of a coil spring.

12. The tension system for an exercise machine of claim 9, wherein said frame includes a first rail and a second rail spaced apart, wherein said plurality of tension units are positioned side-by-side between said first rail and said second rail.

13. The tension system for an exercise machine of claim 9, wherein said plurality of tension units are each vertically oriented.

14. The tension system for an exercise machine of claim 9, wherein said flexible members of said plurality of tension units extend parallel with respect to each other.

15. The tension system for an exercise machine of claim 9, wherein said tension system further comprises a housing having an opening, wherein said reel is rotatably positioned within said housing and wherein said flexible member extends through said opening.

16. The tension system for an exercise machine of claim 10, wherein said movable carriage includes a retainer and wherein each of said plurality of tension units is further comprised of an attachment member connected to said second end of said flexible member, wherein said retainer is adapted to removably receive said attachment member of said flexible member.

17. The tension system for an exercise machine of claim 16, wherein said retainer is comprised of a plate having a plurality of receiver slots adapted to removably retain said attachment member.

18. A tension system for an exercise machine, comprising:

an exercise machine having a frame and a movable carriage, wherein the frame includes a first end and a second end;

wherein the frame includes a first rail and a second rail distally spaced apart, wherein the movable carriage is movably positioned upon the first rail and the second rail, wherein the movable carriage is adapted for reciprocating movement between the first end and the second end of the frame during execution of an exercise; and a plurality of vertically oriented tension units attached to the exercise machine;

wherein each of the tension units is comprised of:

a reel;

a flexible member wound around the reel, wherein a first end of the flexible member is connected to the reel and a second end of the flexible member is removably attached to the movable carriage, wherein the flexible member has an elongated structure that is operatively engaged with the movable carriage, and wherein the flexible members of the plurality of tension units extend from their respective reels in a direction that is parallel to each other; and a torsion spring secured to the reel such that the torsion spring exerts resistance on rotation of the reel as the flexible member is unwound from the reel;

wherein the plurality of tension units are positioned side-by-side between the first rail and the second rail of the exercise machine and below a lower surface of the movable carriage;

wherein the plurality of tension units jointly provide a linear resistance to movement of the movable carriage in a first direction;

and wherein the level of the linear resistance is determined by the number of the plurality of tension units operatively engaged with the movable carriage and the linear resistance is increased by operatively engaging additional tension units to the movable carriage.

19. The tension system for an exercise machine of claim 18, wherein said torsion spring is comprised of a coil spring.

* * * * *